US009739002B2

(12) United States Patent
Beach et al.

(10) Patent No.: US 9,739,002 B2
(45) Date of Patent: Aug. 22, 2017

(54) PROFILED PILE CUTTER

(71) Applicant: GROZ-BECKERT KG, Albstadt (DE)

(72) Inventors: Timothy Beach, Rainsville, AK (US); Herbert Schwane, Raesfeld (DE); Michael Klein, Marl (DE)

(73) Assignee: GROZ-BECKERT KG, Albstadt (DE)

( * ) Notice: Subject to any disclaimer, the term of this patent is extended or adjusted under 35 U.S.C. 154(b) by 0 days.

(21) Appl. No.: 15/123,182

(22) PCT Filed: Mar. 2, 2015

(86) PCT No.: PCT/EP2015/054327
§ 371 (c)(1),
(2) Date: Sep. 1, 2016

(87) PCT Pub. No.: WO2015/132211
PCT Pub. Date: Sep. 11, 2015

(65) Prior Publication Data

US 2017/0058439 A1 Mar. 2, 2017

(30) Foreign Application Priority Data

Mar. 3, 2014 (DE) ..... 10 2014 102 801

(51) Int. Cl.
*D05C 15/24* (2006.01)
*D05C 15/22* (2006.01)

(52) U.S. Cl.
CPC ..... *D05C 15/24* (2013.01); *D05C 15/22* (2013.01)

(58) Field of Classification Search
CPC ..... D05C 15/20; D05C 15/22; D05C 15/24
See application file for complete search history.

(56) References Cited

U.S. PATENT DOCUMENTS

| | | | | |
|---|---|---|---|---|
| 4,155,318 | A * | 5/1979 | Yamamoto | D05C 15/22 112/80.59 |
| 4,602,576 | A * | 7/1986 | Cox | D05C 15/22 112/80.55 |
| 5,345,885 | A * | 9/1994 | Yoshino | D05C 15/24 112/80.55 |
| 8,082,862 | B2 * | 12/2011 | Hillenbrand | D05C 15/22 112/80.59 |
| 8,302,546 | B2 * | 11/2012 | Bitzer | D05C 15/22 112/80.5 |
| 8,430,042 | B2 * | 4/2013 | Hillenbrand | D05C 15/24 112/80.55 |
| 2007/0200286 | A1 * | 8/2007 | Hillenbrand | D05C 15/36 271/204 |
| 2008/0264314 | A1 * | 10/2008 | Hillenbrand | D05C 15/22 112/80.5 |
| 2017/0058439 | A1 * | 3/2017 | Beach | D05C 15/22 |

* cited by examiner

*Primary Examiner* — Danny Worrell
(74) *Attorney, Agent, or Firm* — Fitch, Even, Tabin & Flannery LLP

(57) ABSTRACT

The pile cutter 10 according to the invention allows tufted goods to be produced using materials which, for example, have a friction-reducing coating for forming a dirt-repellant surface that is soft to the touch. Such materials are known to be problematic in the production of pile and occasionally irregular pile is produced. Adjacent to the narrow cutting edge 25 of the pile cutter 10 according to the invention is a comparatively broader step 27 and 33, which prevents the loop from slipping, without cutting into the latter.

12 Claims, 1 Drawing Sheet

PROFILED PILE CUTTER

CROSS REFERENCE TO RELATED APPLICATIONS

This patent application is the national phase of PCT/EP2015/054327 filed Mar. 2, 2015, which claims the benefit of German Patent Application No. 10 2014 102 801.5 filed Mar. 3, 2014.

TECHNICAL FIELD

The invention relates to a pile cutter for tufting machines, in particular for the production of cut pile.

BACKGROUND

Pile cutters for tufting machines have been known from various prior-art embodiments. For example, document U.S. Pat. No. 2,090,021 discloses a pile cutter with a gripper finger being provided on its underside with a cutting edge having two steps. Furthermore, a cutting knife arranged in the pile cutter is disposed for cutting the open the taken up loops in a targeted manner in order to produce cut pile.

Furthermore, document EP 0 200 810 A1 shows a pile cutter having a hard-metal inlay that defines a cutting edge offset upward relative to the lower edge of the pile cutter. Adjoining the cutting edge, there is a step on which extends a straight edge up to the free end of the pile cutter. A leaf spring is movably arranged on the pile cutter in longitudinal direction of the gripper finger. By sliding the leaf spring forward or retracting it, the cutter can be switched from one operating mode in which the loop pile is produced into another operating mode in which the cut pile is produced.

Knives moving next to the grippers are used in the production of cut pile in most cases. A problem occurring here is the asymmetrical cut. The loops grasped by the pile cutter tend to be cut open not precisely on their vertex but slightly to the side, thus resulting in a not fully uniform pile height. In order to eliminate this problem, document EP 1 953 290 A1 has suggested that a lateral recess be provided on the pile cutter. On the other side of the pile cutter there is provided a flat hard metal inlay that supports the cutting edge. Due to the recess, the pile cutter is particularly narrow at the cutting edge, so that taken up loops are cut at least approaching their vertex.

Still, problems may result when the loops consist of particularly slippery material. If these are shifted in longitudinal direction of the cutting edge before or during the cutting operation, the loop may draw, and the cut may not be clean or, again, be off-center.

In order to prevent a slipping of the loops on a pile cutter, document EP 76783 B1 suggests that a serrated cutting edge be formed on a pile cutter for cut pile. This serration of the cutting edge prevents a slipping of the taken up loops in longitudinal direction of the pile cutter.

Furthermore, document U.S. Pat. No. 1,907,292 discloses a pile cutter with a toothed cutting edge.

In addition, document U.S. Pat. No. 2,842,080 discloses a pile cutter with a stepped cutting edge for the production of various pile heights.

In the production of cut pile using particularly slidable, however cutting-resistant, pile thread the latter tends to evade ahead of the cutting knife. Therefore, during the cutting operation, the thread may be shifted along the cutting edge and be ultimately partially cut or cut all the way through due to the increasing tension on the cutting edge, while the cut is not guided cleanly by the knife. This is true, in particular, for materials that slide easily but, at the same time, are not easy to cut such as, e.g., certain synthetics, for example polyester threads, or coated threads that are used in the production of dirt-repellant carpeting.

SUMMARY

It is the object of the invention to provide a pile cutter that is also suitable for difficult materials.

The pile cutter in accordance with the invention comprises a gripper finger that is provided with a cutting edge on its underside. This cutting edge adjoins an elevation that has a width to be measured transversely to the cutting edge, said width being greater than the width of the cutting edge to be measured in the same direction. As a result of this, the cutting edge may be made particularly narrow, in which case a symmetrical cut can be achieved in the vicinity of the vertex of the loop taken up by the pile cutter. However, the elevation adjoining the cutting edge displays a greater width than the cutting edge, so that threads moving up there—even if they tighten against the elevation during the work process—are not cut open without the action of the cutting knife. Preferably, the elevation does not have a sharp edge that comes into contact with the thread.

A hook may be provided on the free end of the gripper finger. This hook is disposed to pick up loops and take over said loops from a tufting needle. The hook may be a downward angled section of the gripper finger.

Typically, the pile cutter has two lateral surfaces as well as, in between, one upper and one lower narrow side. In doing so, the lateral surfaces are those surfaces along which the sides of the taken-up loops are sliding. The lower narrow side is that side which faces away from the carrier material of the tufting goods to be manufactured. As opposed to this, the upper narrow side is that side which faces the carrier material, this side also being referred to as the backing. These descriptions of directions apply independently of the orientation relative to the viewer. The term "upper" generally refers to the side facing the backing, "upward" refers to the direction toward the backing. The term "lower" generally refers to the side facing away from the backing, "downward" refers to the direction away from the backing.

The lateral surfaces may be oriented parallel to each other. It is also possible to taper the gripper finger along its entire length, or over a part thereof, toward its free end, so that the lateral surfaces are oriented at an acute angle with respect to each other. Preferably, the lateral surfaces are flat with the exception of said recess and any potential elevations provided on one or both lateral surfaces. On the hook of the gripper fingers, they may extend toward each other at an acute angle and/or transition into a rounded region.

Preferably, the gripper finger is provided with a recess that is sunk into one lateral surface and extends at least through the lower narrow side. In doing so, only one narrow surface region bordered by a sharp edge remains of the narrow side. This surface region is referred to as the "cutting edge". Between the cutting edge and the adjoining lateral surface, there is formed a sharp edge on which the loop is severed by the associate knife. The recess is adjacent to the cutting edge. The cutting edge may extend beyond the recess in one or both its ends. Conversely, it is also possible that the recess extends on one or both its ends beyond the cutting edge.

Preferably, the cutting edge is configured so as to be straight. However, if needed, it may also be convoluted or otherwise profiled. In doing so, however, it is preferably located in a plane in which is also located that lateral surface of the gripper finger which delimits the sharp edge of the cutting edge. The cutting edge may be oriented parallel to the upper narrow side of the gripper finger or also at an acute angle relative thereto.

The elevation adjacent the cutting edge may be a step rising from the cutting edge, said step being arranged on the lower narrow side of the gripper finger. In doing so, the elevation may display the width of the gripper finger existing at this location. In doing so, the width is to be measured as the distance between the lateral surfaces. Consequently, in this case the elevation projects only downward beyond the cutting edge and is flush with the lateral surfaces. On its side facing the hook, the elevation may have a sliding ramp surface, so that a loop catching space is formed between the hook and the sliding ramp surface.

Alternatively or additionally, the elevation may also extend across one of the lateral surfaces or both lateral surfaces. Also in this case the elevation is preferably arranged on that end of the cutting edge which faces the free end of the gripper finger. The recess may extend into a lateral elevation. The thusly configured elevation prevents a sliding of the loop off the cutting edge and an unclean cutting or partial cutting of said loop.

Additional details of advantageous embodiments of the invention are the subject matter of the description or the claims and the drawings. They show in

DETAILED DESCRIPTION

Figure 1:
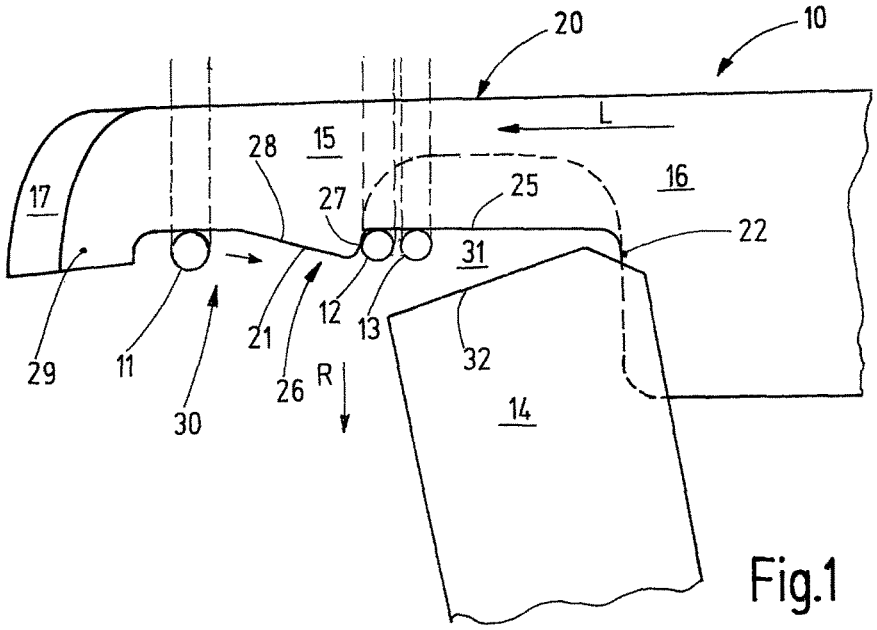
FIG. 1 a lateral view and representation of the principle of a pile cutter with indicated loops and associate knife.

FIG. 1 is a schematic representation of a pile cutter 10 of an otherwise not specifically illustrated tufting machine. The pile cutter 10 is one of a larger number of pile cutters that are held together on a sinker of a tufting machine in order to be moved in a synchronous manner. Each pile cutter 10 is disposed to take up loops 11, 12, 13 of tufting threads that are punched through a carrier material referred to as "backing" in order to form a pile. The backing and the associate tufting needle are not shown in FIG. 1. The pile cutter 10 is disposed for the production of cut pile. To accomplish this, the pile cutter 10 is associated with a knife 14 that is disposed to cut open the picked-up loops 11 to 13. To do so, the knife 14 is moved up and down (upward and downward) in order to cut open the loops 13, 14 in the vicinity of their vertex in such a manner that sides having substantially the same lengths are formed.

Figure 2:
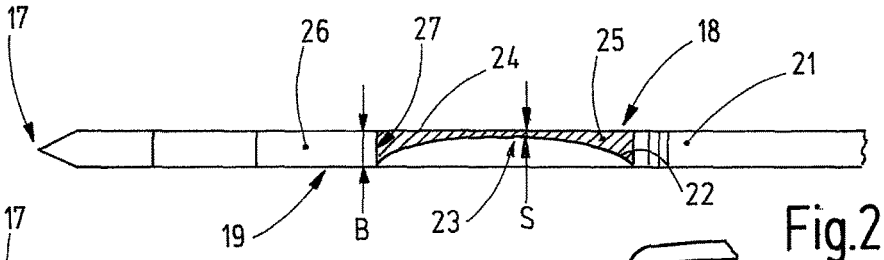
FIG. 2 the pile cutter according to FIG. 1, viewed from the bottom.

The pile cutter 10 is made of flat material and shown in FIG. 2—additionally to FIG. 1—in a view from the bottom. As is obvious from both figures, the pile cutter 10 comprises a gripper finger 15 that extends from a holding end 16 to a free end 17. The holding end 16 is disposed for mounting the pile cutter 10 to the sinker. The free end 17 is disposed to take loops off a tufting needle.

The pile cutter 10 has two lateral surfaces 18, 19 that, for example, may be configured as flat sides and, in particular, as planar surfaces. The lateral surfaces 18, 19 are those surfaces along which the sides of the loops 11 to 13 are sliding. During use, they are positioned essentially at a right angle with respect to the backing, as well as essentially parallel to the flat knife 14. Substantially smaller from the viewpoint of surface size are an upper narrow side 20 facing the backing and a lower narrow side 21 facing away from the backing. At the transition from the gripper finger 15 to the holding end 16, the lower narrow side 21 has a step 22 which has a size such that no loop may move beyond this step 22 to the holding end 16. The step 22 extends essentially at a right angle with respect to the longitudinal direction L of the gripper finger 15.

On its free end 17, the gripper finger 15 transitions into a wedge form in order to be able to take up loops such as the loop 11 by a secure process. Other than that, the lateral surfaces are, as mentioned, preferably parallel to each other—on the gripper finger 15, as well as on the holding end 16. However, it is also possible to orient the lateral surfaces together—or, for example, starting at step 22—at an acute angle relative to each other, so that the gripper finger 15 becomes slimmer from its holding end toward its fee end 17. Additional modifications are possible. For example, the lateral surfaces 18, 19 may be slightly crowned or domed.

Considering the pile cutter 10 according to the invention, the lower narrow side 21 is configured in a special manner. A recess 23 extending through the lateral surface 19 is open toward the underside of the gripper finger 15 and thus also extends through the lower narrow side 21. On the opposite side, a sharp edge 24 is formed on the lower edge of the lateral surface 18. The section of the lateral surface 18 adjoining the sharp edge 24 is preferably flat and forms a knife sliding surface for the knife 14. The knife sliding surface and the sharp edge 24 may be provided on the body of the one-piece gripper finger 15, said body consisting of steel, for example. However, in order to form a sharp edge 24 and the sliding surface, the gripper finger may also comprise an inlay, e.g., a hard metal inlay. This inlay is seated in a flat pocket formed in the lateral surface 18 and is secured therein in an interlocking or material-bonded manner by suitable means. It may be soldered, welded, cemented and/or clamped or additionally or supplementally fastened to the gripper finger 15. Such an inlay is not shown in the figures. In any event, the thickness of the inlay is smaller than the thickness of the gripper finger 15 in order to allow the formation of the recess 23.

Of the narrow side 21 there only remains a reduced surface shown cross-hatched in FIG. 2, said surface being hereinafter referred to as the cutting edge 25. The cutting edge 25 is delimited on the sides of the lateral surface 19 by the recess 23 and on the sides of the lateral surface 18 by the sharp edge 24. Toward the holding end 16, the cutting edge 25 is delimited by the step 22. Toward the free end 17, the cutting edge 25 is delimited preferably by a short-nosed elevation 26 that extends from the lower narrow side 21 in downward direction. In conjunction with this, the term "downward" is indicated as a direction R that is oriented substantially at a right angle with respect to the longitudinal direction L and thus at a right angle with respect to the backing. The direction R is parallel to the lateral surfaces 18, 19.

One step 27 of the elevation 26 borders the cutting edge 25. Preferably, the step 27 is thus substantially oriented at a right angle with respect to the cutting edge 25. The step 27 preferably transitions in a rounded region into a sliding ramp surface 28 that preferably is longer than the surface of the step 27. The sliding ramp surface 28 is preferably oriented at an acute angle with respect to the longitudinal direction L. Furthermore, it is preferably oriented at an acute angle with respect to the longitudinal direction L. The cutting edge 25 is preferably oriented parallel to the longitudinal direction L. The sliding ramp surface 26 can delimit a loop catching space 30 with a hook 29 extending downward as an extension, said hook being formed to the free end of the gripper finger 15. This loop catching space is disposed for collecting the loops 12, 13 that are later to be transferred into the cutting space 31. The cutting space 31 is delimited below the cutting edge by the steps 22, 27.

Figure 3:
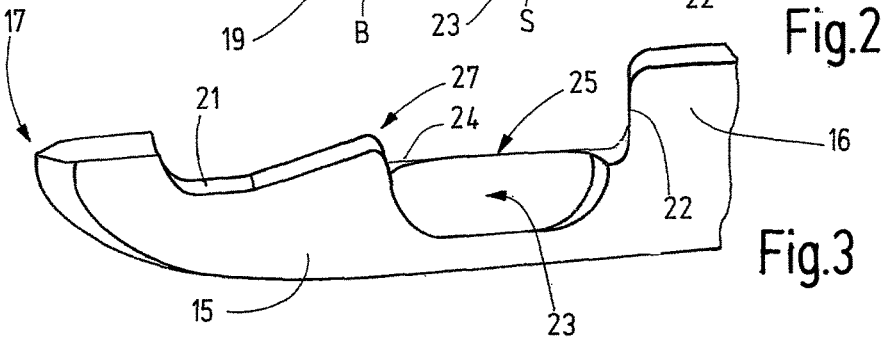
FIG. 3 a perspective view of the pile cutter according to FIGS. 1 and 2.

As can be inferred from FIG. 2 in particular, the elevation 26 extends from one lateral surface 18 to the other lateral surface 19. Accordingly, it has a width B that is greater than the width S of the cutting edge. In doing so, the width S of the cutting edge is the smallest distance of the recess 23 from the lateral surface 18 and thus is understood to be the smallest width that is displayed by the cutting edge 25 that is configured as a narrow strip. The relationships can be inferred from FIGS. 2 and 3. Preferably, the width S of the cutting edge 25 is smaller than half the width B of the elevation 26.

The pile cutter 10 described so far operates as follows:

During operation, the pile cutter 10 performs an oscillating back-and-forth movement in longitudinal direction L. This movement may be superimposed by an additional pivoting movement, in which case the pile cutter 10 obvious from FIG. 1 pivots to the left in order to take up a loop punched through the backing by a tufting needle and hold it like the loop 11 upon retraction of the needle. The backing that is intermittently moved to the right during the tufting process takes along the corresponding loops until they—like the loops 12, 13—have passed the sliding ramp surface 28 and come to rest on the cutting edge 25. The knife 14 that is rhythmically moved up and down cuts them open with its cutting edge 32 at this location.

The loops 11, 12 preferably consist of a highly slidable, for example anti-adhesion-coated material, that offers high resistance to cutting as is the case, for example, with polyester. However, the inventive pile cutter is also suitable for non-problematic yarns such as wool, cotton or other natural fibers or synthetic fibers.

When the cutting edge 32 acts on the loops 12, 13, they cannot leave the cutting space 31. The step 27 effectively prevents the loops 12, 13 from slipping and being elongated or drawn in any other way. At the same time, the step 27—due to its great width B—offers a planar contact surface for the lower U-shaped sections of the loops 12, 13, so that they—even if they are firmly pressed against the step 27—are not partially cut or partially torn. This will not occur, even if the step 27 transitions into the lateral surfaces 18, 19 at an extremely minimal radius of curvature. However, if necessary, the transition from the step 27 to the lateral surfaces 18, 19 may also be rounded.

Figure 4:
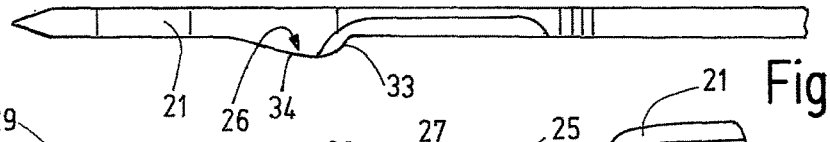
FIG. 4 a modified embodiment of a pile cutter, in a view according to FIG. 2, viewed from the bottom.
Figure 5:
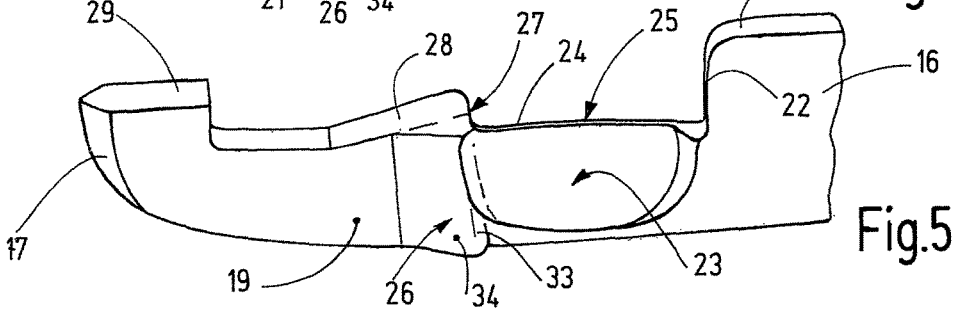
FIG. 5 a perspective representation of the modified pile cutter according to FIG. 4.

The elevation 26 need not necessarily be arranged on the lower narrow side 21. Alternatively or additionally, it may be arranged on one of the two lateral surfaces 18, 19 or on both lateral surfaces. FIGS. 4 and 5 illustrate, as an example, an embodiment wherein the elevation 26 is both arranged on the narrow side 21 and additionally takes up a portion of the lateral side 19. The description given hereinabove regarding FIGS. 1 to 3 applies accordingly. In addition, it is pointed out that the elevation 26—to the extent that it is provided on the lateral surface 19—can have a step surface 33 facing the recess 23, said step surface potentially having the recess 23. The latter measure may be used to keep the cutting edge 25 up to the step 27 relatively narrow in order to produce sides of loops having as much as possible the same length when the loops 12, 13 are being cut. The step surface 33 preferably transitions in a round portion into a sliding surface 34 that is at an acute angle with respect to the other lateral surface 19. The length of the sliding surface 34 may correspond to the length of the sliding ramp surface 28 or, as illustrated in FIG. 5, be defined in a different manner. The step surface 33 may be oriented at a right angle with respect to the lateral surface 19 or, according to FIG. 4, also be oriented at another angle, for example an oblique angle, with respect thereto.

If the elevation 26 is provided on a lateral surface 18 and/or 19, it is not necessary to provide such an elevation at the same time on the narrow side 21. In this case, the width B is measured from the lateral surface 18 up a the point of the lateral elevation 26, said point being laterally the farthest projecting. In any event, this width is greater than the width S, preferably at least twice the width S and, even more preferably at least three times the width S. This also applies to embodiments wherein the elevation 26 takes up the narrow side 21 as well as a portion of the lateral surface 19.

However, an embodiment according to one of the figures is preferred. It is pointed out that it is possible to provide—on the narrow side 21, as well as on the lateral surface 18 and/or the lateral surface 19—also two or several such elevations instead of one single elevation 28, which elevations may be arranged, for example, in a stepped manner in longitudinal direction so as to respectively prevent a sliding back of taken up loops during the movement of the tufting gripper and the backing. However, it is essential to prevent the evading or slipping away of the loops 12, 13 when cutting is performed by the blunt, non-cutting step 27 or step surface 33.

The pile cutter 10 according to the invention allows the production of tufted goods using materials which, for example, have a friction-reducing coating for forming a dirt-repellant surface that is soft to the touch. Such materials are known to be problematic in the production of cut pile and occasionally irregular pile heights are produced. Adjacent its narrow cutting edge 25, the pile cutter 10 according to the invention is provided with a comparatively broader step 27 or 33, which prevents the loop from slipping, without cutting into said loop.

List of Reference Signs:

| | |
|---|---|
| 10 | Pile Cutter |
| 11, 12, 13 | Loops |
| 14 | Knife |
| 15 | Gripper finger |
| 16 | Holding end |
| 17 | Free end |
| 18, 19 | Lateral surfaces |
| 20 | Upper narrow side |
| 21 | Lower narrow side |
| 22 | Step |
| L | Longitudinal direction |
| 23 | Recess |
| 24 | Sharp edge |
| 25 | Cutting edge |
| 26 | Elevation |
| R | "Downward" direction |
| 27 | Step |
| 28 | Sliding ramp surface |
| 29 | Hook |
| 30 | Loop catching space |
| B | Width of the elevation 26 |
| S | Width of the cutting edge 25 |
| 31 | Cutting space |
| 32 | Cutting edge of the knife 14 |

-continued

| List of Reference Signs: | |
|---|---|
| 33 | Step surface |
| 34 | Sliding surface |

The invention claimed is:

1. Pile cutter (10) for a tufting machine, wherein the pile cutter (10) comprises:

a gripper finger (15) that defines and extends between a holding end (16) and a free end (17), wherein the gripper finger defines and comprises:

a cutting edge (25), an elevation portion (25) arranged adjacent the cutting edge (25) toward the free end (17), and a hook (29) is provided on the free end (17) of the gripper finger (15), wherein the elevation (26) adjacent the cutting edge (25) is formed by a step (27) rising from the cutting edge (25), said step being arranged on a narrow side (21) of the gripper finger (15), wherein the elevation (26) has a width measured transversely to the cutting edge (25), said width being greater than a transverse width of the cutting edge (25), wherein the step (27) is formed by a projection having a sliding ramp surface (28) arranged obliquely with respect to the cutting edge (25), and wherein a loop catching space (30) is defined between the sliding ramp surface (28) and the hook (29).

2. Pile cutter as in claim 1, wherein the gripper finger (15) has two lateral surfaces (18, 19) as well as, in between, one upper and one lower narrow side (20, 21), in which case the cutting edge (25) is formed between one of the lateral surfaces (18, 19) and the lower narrow side (21).

3. Pile cutter as in claim 1, wherein a lateral surface (18) adjoining the cutting edge (25) has a flat surface section extending away from the cutting edge (25).

4. Pile cutter as in claim 2, wherein the gripper finger (15) is provided with a recess (23) that is sunk into one lateral surface (19) and extends through a narrow side (21).

5. Pile cutter as in claim 4, wherein the recess (23) is adjacent the cutting edge (25).

6. Pile cutter as in claim 1, wherein the cutting edge (25) is straight.

7. Pile cutter as in claim 1, wherein the cutting edge (25) is profiled.

8. Pile cutter as in claim 1, wherein the elevation (26) adjacent the cutting edge (25) is formed by a step (27) rising from the cutting edge (25), said step being arranged on a narrow side (21) of the gripper finger (15).

9. Pile cutter as in claim 4, wherein the elevation (26) is arranged so as to be adjacent the recess (23).

10. Pile cutter as in claim 1, wherein the elevation has a step surface (33) facing the recess (23).

11. Pile cutter as in claim 1, wherein the recess (23) is sunk in the elevation (26).

12. Pile cutter (10) for a tufting machine, wherein the pile cutter (10) comprises:

a gripper finger (15) that extends from a holding end (16) to a free end (17), and comprises a lateral surface (18, 19), and is provided with a cutting edge (25) on its underside (21), and wherein an elevation (26) is arranged adjacent the cutting edge (25) toward the free end (17), wherein the elevation (26) has a width measured transversely with respect to the cutting edge (25), said width being greater than a transverse width of the cutting edge (25), wherein the elevation (26) is arranged on one or on both of the two lateral surfaces (18, 19) and has a step surface (33) facing the recess (23).

* * * * *